US007802459B2

(12) United States Patent
Lovsin et al.

(10) Patent No.: US 7,802,459 B2
(45) Date of Patent: Sep. 28, 2010

(54) CONDUIT BENDER WITH METHOD AND SYSTEM FOR MAKING NINETY DEGREE BENDS

(76) Inventors: James Lee Lovsin, 1808 Santa Fe Dr., Apt. 102, Naperville, IL (US) 60563; Ryan Daniel Sochol, 47 Maple Ave., North Westport, CT (US) 06880; James Michael Worth, 3625 Duval Rd., Apt. 211, Austin, TX (US) 78759; Erin Virdone, 838 N. Kalaheo Ave., Apt. A, Kailua, HI (US) 96734

( * ) Notice: Subject to any disclaimer, the term of this patent is extended or adjusted under 35 U.S.C. 154(b) by 173 days.

(21) Appl. No.: 11/371,765

(22) Filed: Mar. 9, 2006

(65) Prior Publication Data

US 2006/0248937 A1 Nov. 9, 2006

Related U.S. Application Data

(60) Provisional application No. 60/659,922, filed on Mar. 9, 2005.

(51) Int. Cl.
*B21D 9/08* (2006.01)
*B21D 7/06* (2006.01)

(52) U.S. Cl. ..... 72/369; 72/386

(58) Field of Classification Search ..... 72/301, 72/295, 305, 311, 316, 383–385, 306, 307, 72/296, 297, 308, 309, 388, 386, 459, 369
See application file for complete search history.

(56) References Cited

U.S. PATENT DOCUMENTS 2,814,332 A * 11/1957 Molla ..... 425/143
3,385,092 A * 5/1968 Scott ..... 72/381
3,760,626 A * 9/1973 Sharar ..... 72/389.6
3,842,648 A * 10/1974 Schwartz ..... 72/383
4,351,178 A * 9/1982 Uehara et al. ..... 72/383
5,222,384 A * 6/1993 Evans ..... 72/31.05
5,346,454 A * 9/1994 Hayashi ..... 483/29
5,934,132 A 8/1999 Nichol
6,321,584 B1 * 11/2001 Chen et al. ..... 72/295
6,497,131 B1 * 12/2002 Feijen ..... 72/297
6,769,282 B2 * 8/2004 Henden ..... 72/383
6,820,457 B2 11/2004 Luebke et al.
6,834,527 B2 12/2004 Hopwood
7,146,835 B2 * 12/2006 Hruschak et al. ..... 72/7.1

* cited by examiner

*Primary Examiner*—Debra M Sullivan
(74) *Attorney, Agent, or Firm*—McDonnell Boehnen Hulbert & Berghoff LLP

(57) ABSTRACT

A bender for conduit which may make ninety degree bends in a length of conduit. The bender includes a bending frame, a bending deck, a rising shoe assembly and a traveling shoe assembly. A length of conduit is oriented parallel to the bending deck and then a desired portion of the conduit inserted into the traveling shoe assembly and a corresponding portion of the conduit is inserted into the rising shoe assembly. The rising shoe assembly is translated along an axis substantially perpendicular to the bending deck. The traveling shoe assembly is then translated along an axis substantially parallel to the bending deck. The complimentary translations of the rising shoe assembly and traveling shoe assembly cooperatively make a ninety degree bend in the conduit.

2 Claims, 15 Drawing Sheets

CONDUIT BENDER WITH METHOD AND SYSTEM FOR MAKING NINETY DEGREE BENDS

CROSS REFERENCE TO RELATED APPLICATION

This application claims the benefit of U.S. Provisional Patent Application Ser. No. 60/659,922, filed Mar. 9, 2005.

BACKGROUND

1. Field of the Invention

This invention is related to the field of tube bending and more particularly to a bender that may make various types of bends including ninety degree bends in electrical conduit.

2. Description of the Related Art

Electrical conduit is widely used in the construction industry to provide mechanical protection to electrical wires. Electrical conduit is generally metallic tubing that has an inner diameter and an outer diameter and serves to house electrical wiring. Various forms of electrical conduit include electrical metallic tubing (EMT), intermediate metallic tubing (IMC), and galvanized rigid conduit (GRC). Typically, electrical conduit is installed at a job site prior to pulling the installed wiring through the conduit. As wiring may take on complicated paths to avoid obstructions in a structure, electrical conduit often needs to be bent to correspond to these wiring routes.

Although electrical conduit may be bent into a variety of configurations, the construction industry has adopted several common bend configurations which include offset bends, saddle bends, kick bends, and ninety degree bends. An offset bend comprises two equal and opposite bends in a straight length of conduit so that the two ends of the conduit are parallel but are offset a given perpendicular distance. An extension to the offset bend, the saddle bend consists of two complementary offset bends. The saddle bend therefore comprises two bends which are equal and opposite to another two bends. The kick bend, most likely the simplest bend to execute, consists of one bend such that the first end of the conduit is oriented to the second end of the conduit at an angle substantially forty-five degrees. Finally, the ninety degree bend is the most widely used conduit bend. As this terminology implies, a ninety degree bend comprises a bend such that the first end of the conduit is oriented to the second end of the conduit at a substantially ninety degree angle.

To achieve the above bend configurations, the construction industry uses several conduit bending techniques. All of these bending techniques can be broadly grouped into hand benders, power benders, and mechanical benders.

Hand benders are the oldest bending technique in art of conduit bending. Hand benders generally comprise a curved bending shoe for receiving and holding the conduit and leverage means for forming the bend. Even though hand benders are still currently used in the field of tube bending because they are inexpensive and portable, hand benders have significant disadvantages. Since hand benders are only designed to make one bend at a time, bending configurations that include more than one bend are difficult to implement. For example, a tradesmen making an offset bend using a hand bender makes the first bend and then must reposition the hand bender before making the second bend. This repositioning of the hand bender prior to making the second bend leads to highly variable and often inaccurate results. Highly variable results also occur in bend configurations involving one bend because the user force applied to bend the conduit is variable. An additional disadvantage of hand benders is that they are unable to effectively bend larger size conduit. Recent advances in hand benders include improved methods for receiving and holding the conduit in a bending shoe and measurement indicators. Measurement indicators aide a tradesmen in effectively repositioning the hand bender before making a second bend in a bend configuration.

Power benders are large pieces of equipment that typically relay on hydraulics or pneumatics to actuate bending shoes to produce bends in conduit. Power benders are currently adapted to produce offset bends, saddle bends, kick bends, and ninety degree bends. Given that the actuation of the bending shoes is automated, power benders produce highly accurate results. Additionally, the automation and the size of power benders provides for bending of larger sized conduit compared to hand benders. Even though the automation and the size of power benders provide several benefits to the art of conduit bending, this automation and this size makes power benders very expensive and immobile.

Mechanical benders seek to provide the benefits of both hand benders and power benders. Mechanical benders usually consist of bending shoes connected to a light weight bending frame. The bending shoes are generally actuated by a user but the mechanical bender may use gearing or leverage to provide mechanical advantage. Mechanical benders may alternatively be actuated by small electric motors. Several mechanical benders currently exist in the art of conduit bending. U.S. Pat. No. 5,222,384 Evans discloses a reciprocal conduit bender which may make equal and opposite simultaneous bends in a conduit. In addition to making generally accurate bends, mechanical benders are relatively less expensive than power benders, and are typically mobile and consequently may be easily used on construction sites; however, Evans and other mechanical benders have only been adapted to produce offset bends, saddle bends, and kick bends. Since the ninety degree bend is the most widely used bending configuration, the inability of mechanical benders to make ninety degree bends is a severe disadvantage.

Accordingly, what is needed in the art is a conduit bender that provides the advantages of the state of the art mechanical benders and is adapted to make ninety degree bends in electrical conduit. This bender should be generally mobile and should make accurate ninety degree bends in conduit while still being adapted to make accurate offset bends, saddle bends, and kick bends.

SUMMARY

In view of the foregoing disadvantages inherent in the know types of conduit benders now present in the art, the present invention provides a new bender that can make accurate ninety degree bends in electrical conduit wherein the same can also make offset bends, saddle bends, and kick bends in electrical conduit, and the same is inexpensive and the same is mobile. The bender includes a bending frame, a bending deck connected to the bending frame, a traveling shoe assembly, a rising shoe assembly, means to translate the traveling shoe assembly along an axis substantially parallel to the bending deck, and means to translate the rising shoe assembly along an axis substantially perpendicular to the bending deck.

Accordingly, to make a ninety degree bend, a generally straight length of conduit having a first end and a second end is oriented parallel to the bending deck. A desired length of the conduit is inserted into the traveling shoe assembly, and a desired length of conduit is inserted into the rising shoe assembly. The desired length of the conduit that is inserted into the traveling shoe assembly and the desired length of conduit that is inserted into the rising shoe assembly determine the amount of bend that is made by the bender. In a preferred embodiment, the rising shoe assembly is translated along an axis substantially perpendicular to the bending deck by an electric motor. Responsive to the translation of the rising shoe assembly, the traveling shoe assembly simultaneously freely translates along an axis substantially parallel to the bending deck. The dual translation of the rising shoe assembly and traveling shoe assembly cooperatively forms a kick bend in the conduit. Following the formation of the kick bend, the traveling shoe assembly is translated along an axis substantially parallel to the bending deck by a torque input applied by a user that is modified by a gearing system so as to form a ninety degree bend in the conduit.

In an alternative embodiment, the rising shoe assembly is translated along an axis substantially perpendicular to the bending deck by an electric motor. Responsive to the translation of the rising shoe assembly, the traveling shoe assembly simultaneously freely translates along an axis substantially parallel to the bending deck. The dual translation of the rising shoe assembly and traveling shoe assembly cooperatively form a bend in the conduit such that the angle between the first end of the conduit and the second end of the conduit is substantially forty-five degrees. Following the translation of the rising shoe assembly, the traveling shoe assembly is translated along an axis substantially parallel to the bending deck by a torque input applied by the user that is modified by a gearing system so as to form so as to form bend in the conduit such that the angle between the first end of the conduit and the second end of the conduit is substantially ninety degrees. Translation of the rising shoe assembly and translation of the traveling shoe assembly may be performed in the foregoing manner in a repetitive series so as to form a ninety degree bend in the conduit.

The present invention is also adapted to making offset bends in conduit similarly to benders known in the art. To make an offset bend, a generally straight length of conduit having a first end and a second end is oriented parallel to the bending deck. A desired length of the conduit is inserted into the traveling shoe assembly, and a desired length of conduit is inserted into the rising shoe assembly. The desired length of the conduit that is inserted into the traveling shoe assembly and the desired length of conduit that is inserted into the rising shoe assembly determines the amount of bend that is made by the bender. In a preferred embodiment, the rising shoe assembly is translated along an axis substantially perpendicular to the bending deck by an electric motor. Responsive to the translation of the rising shoe assembly, the traveling shoe assembly simultaneously translates along an axis substantially parallel to the bending deck. The dual translation of the rising shoe assembly and traveling shoe assembly cooperatively form equal and opposite bends in the conduit which comprises an offset bend.

Thus, an object of the present invention is as improved bender for electrical conduit. Yet another object of the present invention is an improved bender that can make accurate ninety degree bends in conduit. Another object of the present invention is an improved bender that is relatively inexpensive. Still another object of the present invention is an improved bender that is mobile and may easily maneuvered on a construction job site.

The foregoing objects and many other additional advantages of the present invention will become more readily appreciated in the following detailed description. This detailed description describes a preferred embodiment of the present invention with reference to the accompanying drawings.

BRIEF DESCRPITION OF DRAWINGS

DETAILED DESCRIPTION OF THE PREFERRED EMBODIMENT

Figure 1:
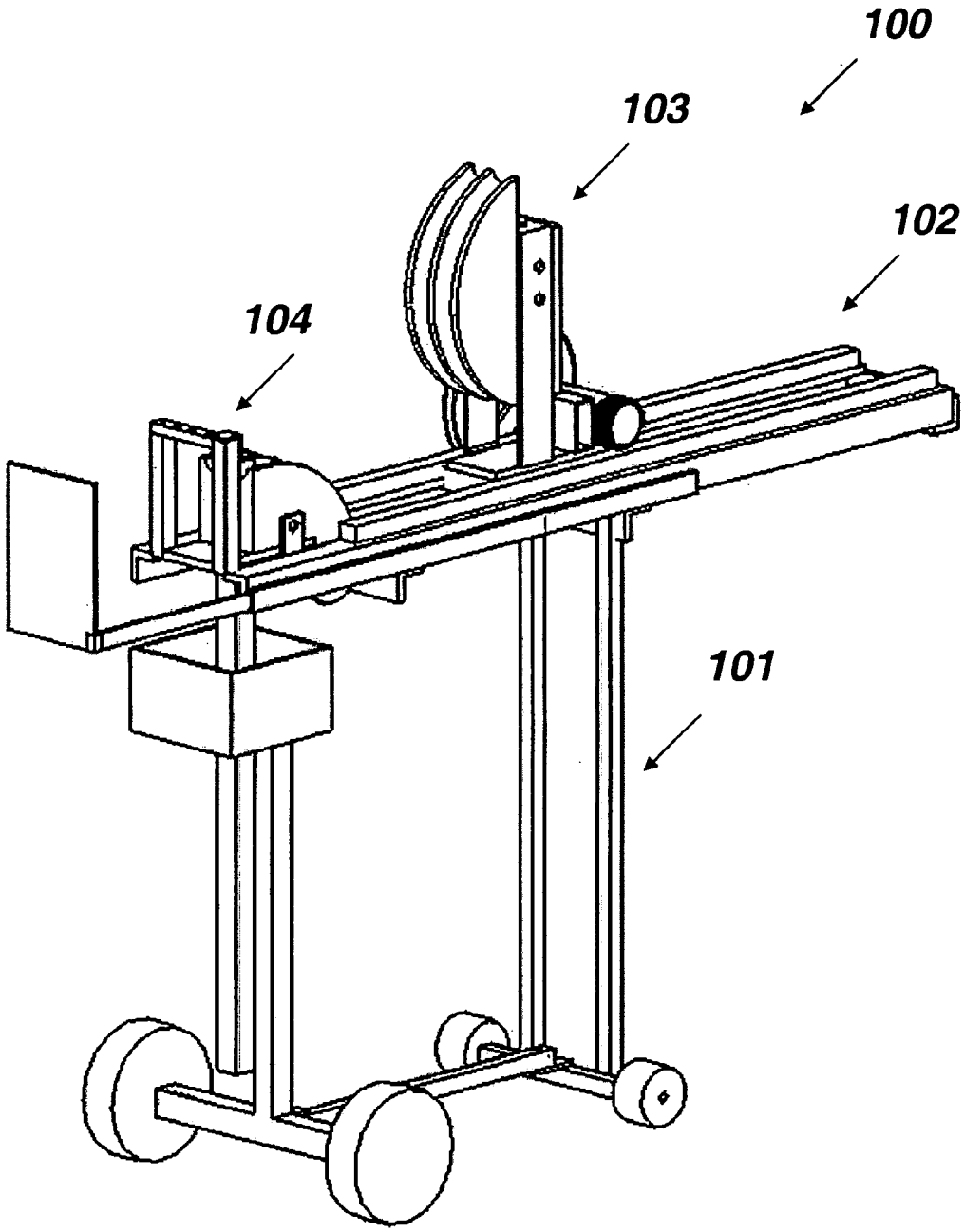
FIG. 1 is a perspective view of a preferred embodiment of a bender according to the present invention.

A preferred embodiment of the present invention will now be described, with reference to the figures, wherein like reference characters denote like elements. Referring now to FIG. 1, a bender 100 according to the present invention is depicted. The major components of the bender are a bending frame 101, a bending deck 102 connected to the bending frame, a traveling shoe assembly 103 which may translate along an axis substantially parallel to the bending deck, and a rising shoe assembly 104 connected to the bending frame that may translate along an axis substantially perpendicular to the bending deck.

Figure 2:
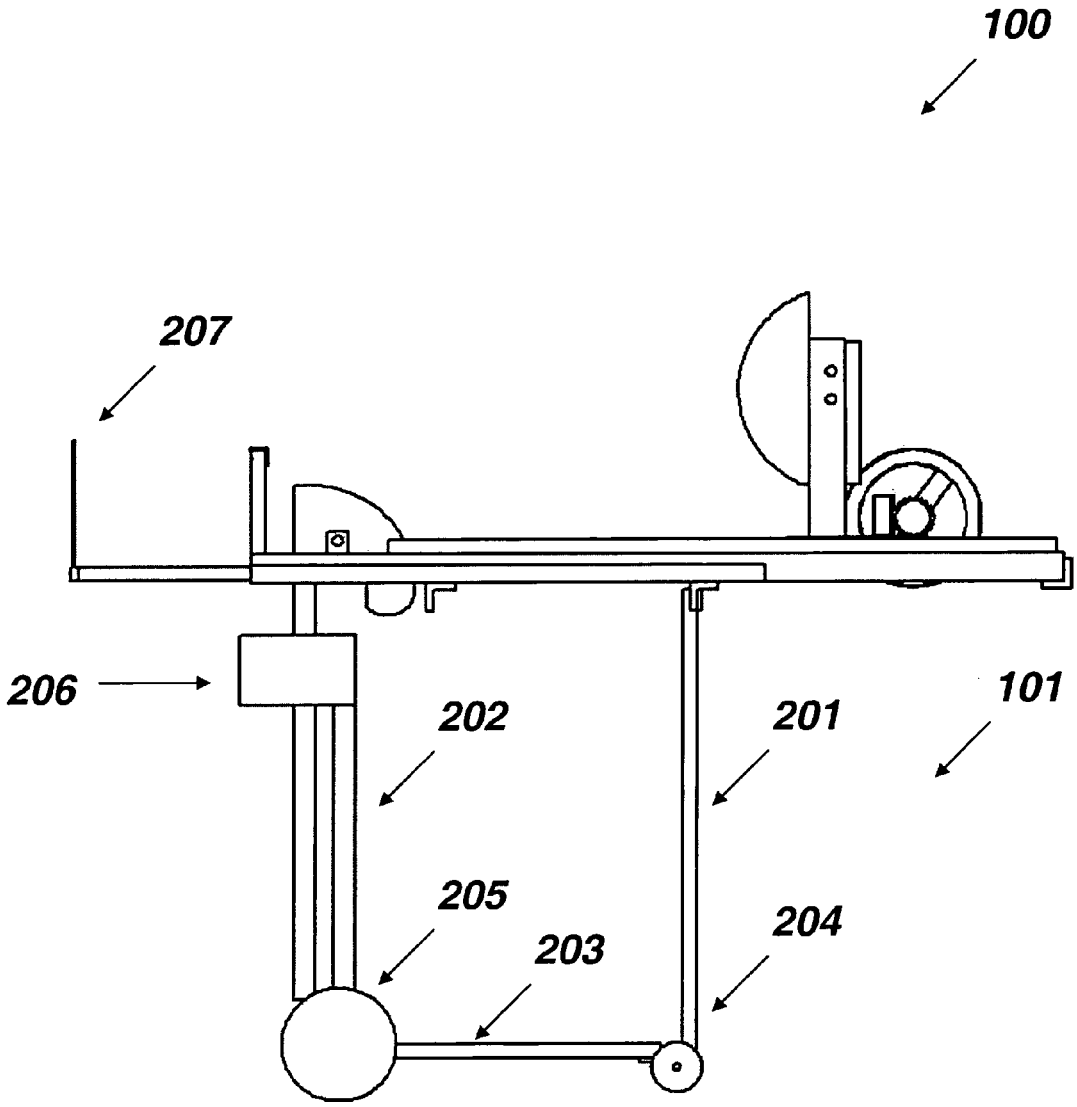
FIG. 2 is a side view of the bender shown in FIG. 1.

Referring now to FIG. 2, a side view of the bender 100 is shown accentuating the bending frame 101. The bending frame 101 consists of a first pair of rails 201 and a second pair of rails 202 both of which are connected perpendicularly to the bending deck 102 such that the bending deck 102 is substantially supported. These two pair of rails are further connected by a connecting rail 203. The frame additionally consists of a first pair of wheels 204 and a second pair of wheels 205, a rising shoe assembly housing 206, and a stop gate 207. The first and second pair of wheels 204, 205 are provided for increased bender mobility. The stop gate 207 is provided for assisting users in making accurate bends. When a substantially straight length of conduit is loaded into the bender 100, the stop gate 207 can be adjusted so that the stop gate contacts an end of the conduit. In this way, the bender 100 can be configured to produce one or more identical bends.

The rising shoe assembly housing 206 houses the rising shoe assembly 104. In the preferred embodiment, the rising shoe assembly housing 206 further houses an electric motor and a gearing system attached to the electric motor and the rising shoe assembly 104. The electric motor and the gearing system provide means to translate the rising shoe assembly 104 along an axis substantially perpendicular to the bending deck 102. In an alternative embodiment, the rising assembly housing 206 would house an apparatus that would provide means to translate the rising shoe assembly 104 along an axis substantially perpendicular to the bending deck 102. For example, a hydraulic piston may be housed in the rising shoe assembly housing 206 to provide the foregoing means of translation.

Exemplary Bending Deck

Figure 3:
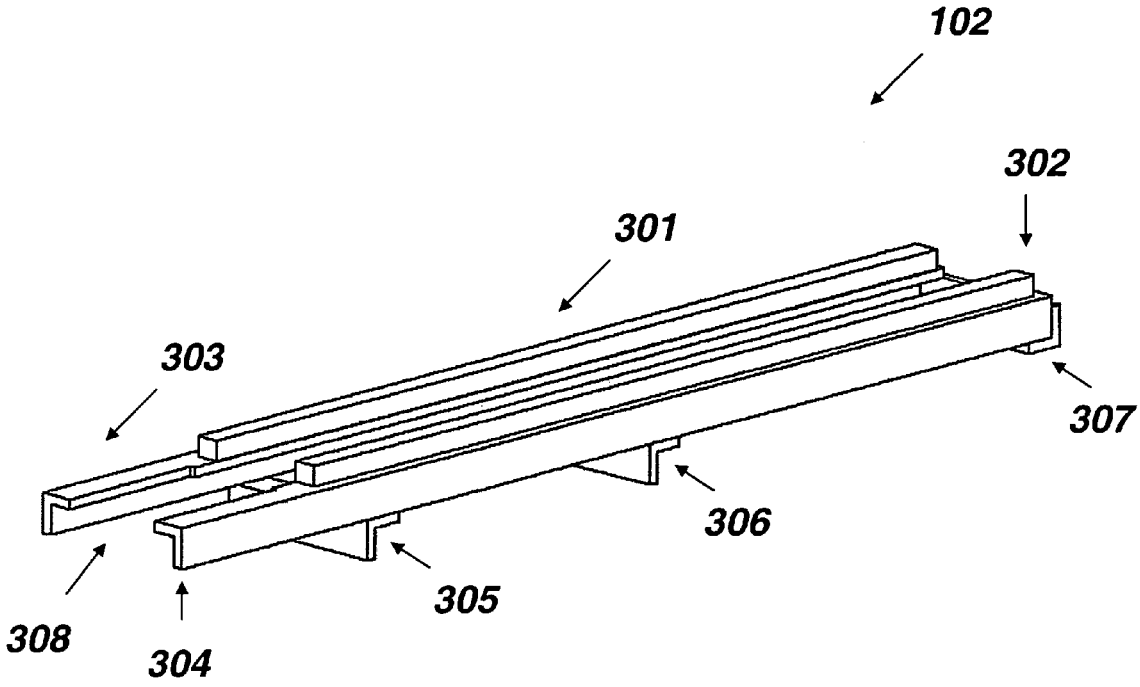
FIG. 3 is a perspective view of the bending deck of the bender shown in FIG. 1.

Referring now to FIG. 3, a perspective view of the bending deck 102 is shown. The bending deck 102 consists of a first gear rack 301 and a second gear rack 302 each of which is correspondingly connected to a first deck rail 303 and a second deck rail 304. The first deck rail 303 is oriented substantially parallel to the second deck rail 304 and is connected the second deck rail by a first deck cross brace 305, a second deck cross brace 306, and a third deck cross brace 307. The first deck rail 303 and the second deck rail 304 are separated by lateral distance which forms a deck cavity 308 there between. The deck cavity 308 allows the traveling shoe assembly 103 to translate along the surface of the first gear rack 301 and the surface of the second gear rack 302.

Exemplary Traveling Shoe Assembly

Figure 4A:
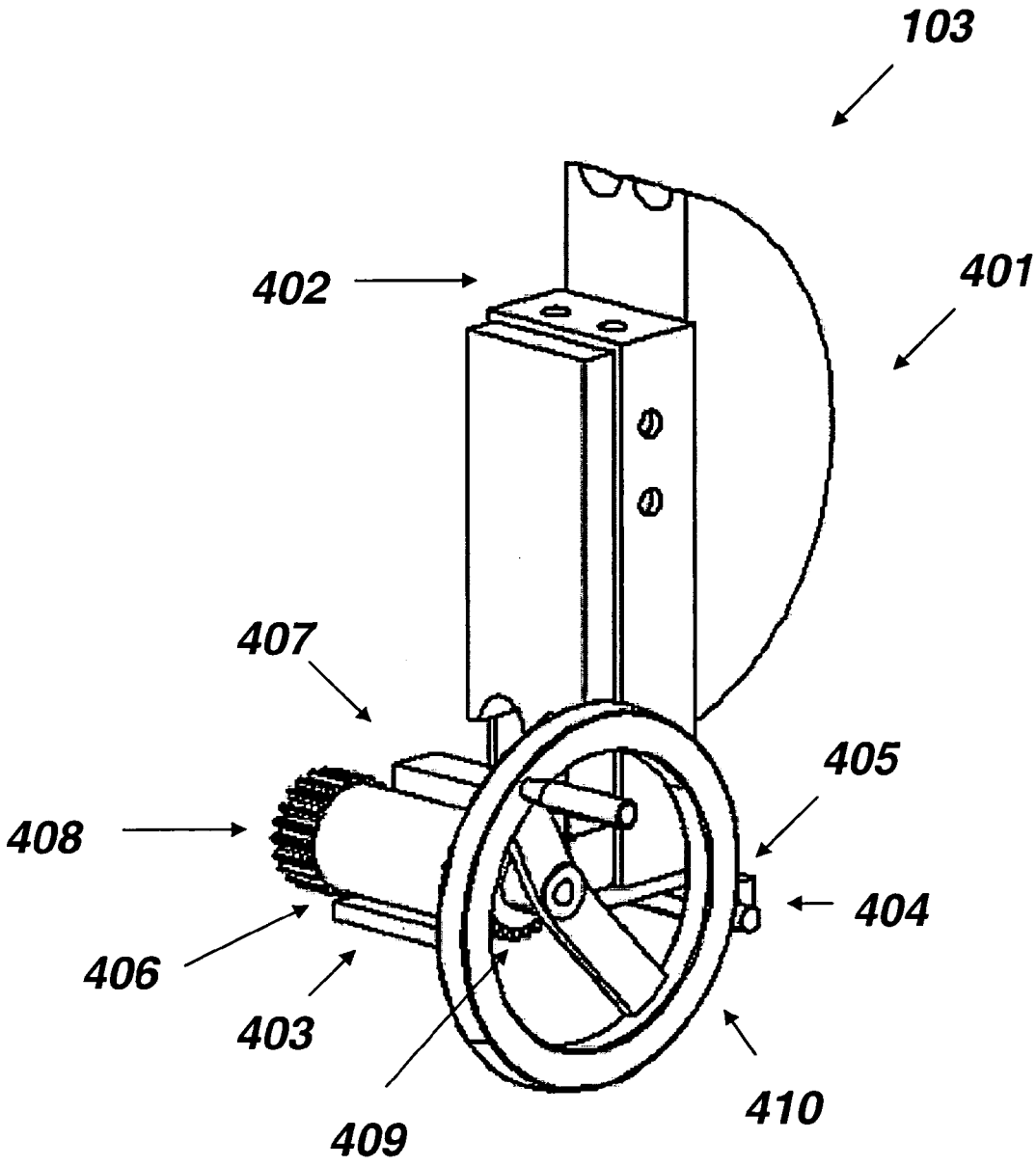
FIG. 4A is a perspective view of the traveling shoe assembly of the bender shown in FIG. 1.
Figure 4B:
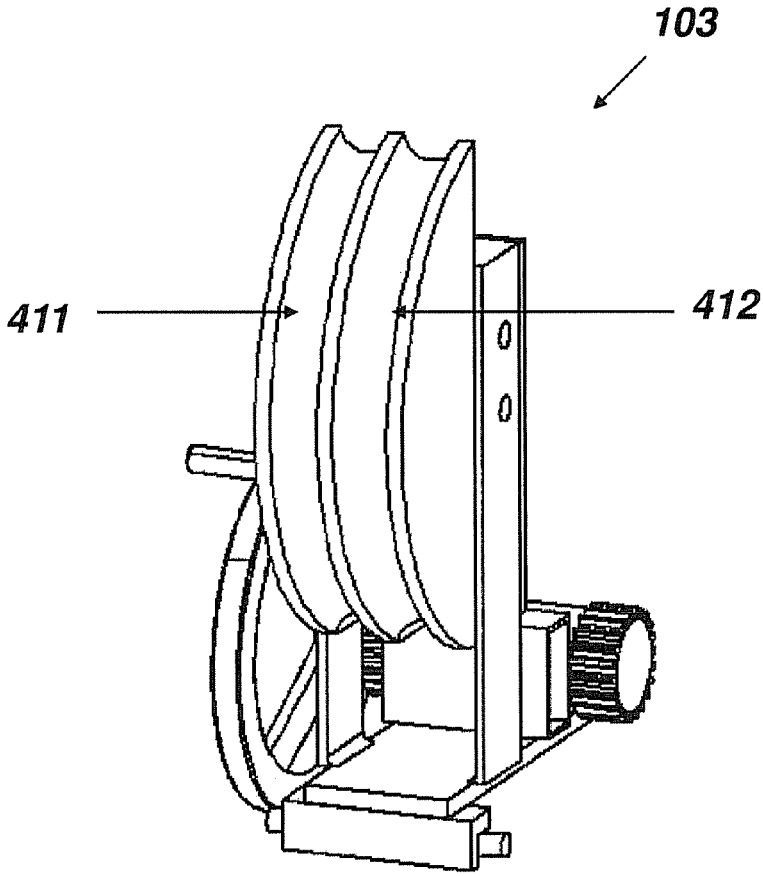
FIG. 4B is an additional perspective view of the traveling shoe assembly of the bender shown in FIG. 1.
Figure 4C:
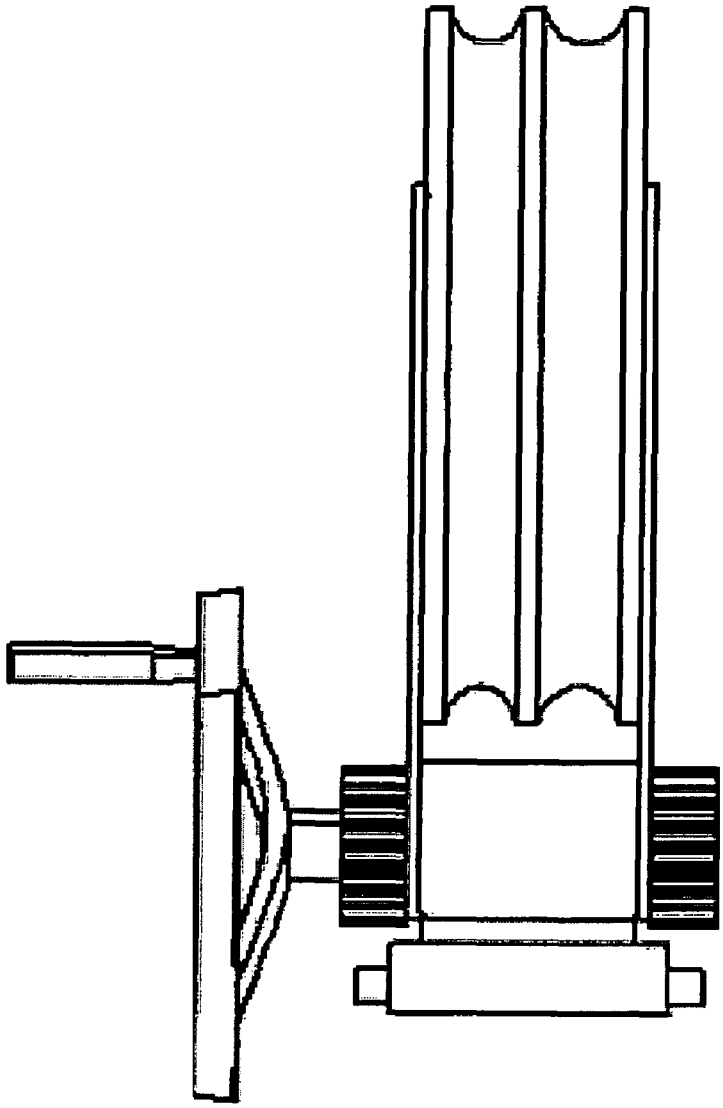
FIG. 4C is a front view of the traveling shoe assembly of the bender shown in FIG. 1.
Figure 4D:
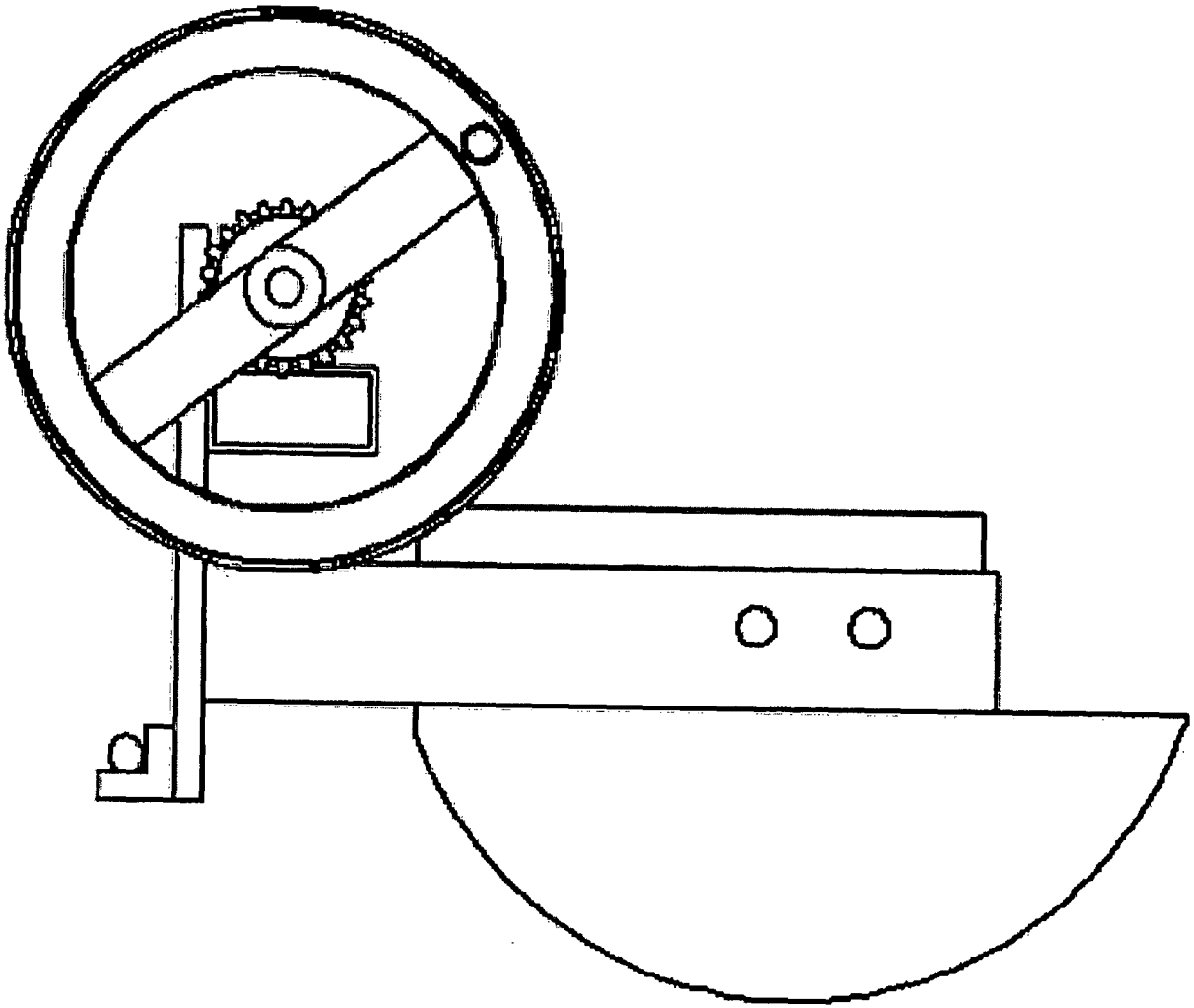
FIG. 4D is a side view of the traveling shoe assembly of the bender shown in FIG. 1.

Referring now to FIG. 4A-4D, the traveling shoe assembly 103 is shown. FIG. 4A and FIG. 4B are perspective views of the traveling shoe assembly and FIG. 4C and FIG. 4D are a side view and a front view of the traveling shoe assembly 103, respectively. Referring to FIG. 4A, the traveling shoe assembly 103 consists of a traveling shoe 401 housed in a traveling shoe housing 402. The traveling shoe housing is connected to the traveling shoe assembly plate 403 which is oriented parallel to the bending deck 103. At the front end of the traveling shoe assembly plate 403 the traveling shoe assembly front attachment rod 404 is connected to the traveling shoe assembly front attachment bracket 405. The traveling shoe assembly front attachment rod 404 sits within the deck cavity 308. In the preferred embodiment, the traveling shoe assembly front attachment rod 404 has means to translate along the underside of the bending deck 102 wherein the traveling shoe assembly front attachment rod 404 remains in rolling contact with the bending deck 102. The foregoing means may be achieved by attaching wheels to the traveling shoe assembly front attachment rod 404.

At the back end of the traveling shoe assembly plate 403 the traveling shoe back attachment rod 406 houses a first gear 408 and a second gear 409. The traveling shoe assembly back attachment rod 406 is connected to the traveling shoe assembly back attachment 407 which is connected to the traveling shoe assembly plate 403. In the preferred embodiment, the first gear 408 and the second gear 409 are connected to the traveling shoe assembly back attachment rod 406 by means of internal components and bearings. In an alternative embodiment, the first gear 408 and the second gear 409 are connected to the traveling shoe assembly back attachment rod 406 by means of internal components and are lubricated. In the bender, the first gear 408 meshes with the second gear rack 302 and the second gear 409 meshes with the first gear rack 301. The first gear 408 and the second gear 409 may translate along their respective meshing racks by means of a user input torque applied to a hand wheel 410 attached to the second gear 409. It will be appreciated that the user applied input torque is sufficient to translate the traveling shoe assembly along the surface of the first gear rack 301 and the surface of the second gear rack 302.

Exemplary Traveling Shoe

Referring to FIG. 4B, an additional perspective view of the traveling shoe assembly 103 is shown. The traveling shoe 401 consists of at least one receiver 411 defining a groove of a predetermined radius for receiving and substantially holding a length of electrical conduit of a predetermined outer diameter. FIG. 4B shows the traveling shoe 103 having two receivers 411 and 412. The first receiver 411 currently defines a radius to successfully bend 1 in GRC and the second receiver 412 currently defines a radius to successfully bend 1¼ in EMT. The radii required for successful bending a length of conduit of a predetermined outer diameter can be determined by referencing appropriate conduit run design codes. For example, the first receiver 411 and the second receiver 412 define respective grooves of respective radii that are recited in the National Electrical Code 346-10. In the preferred embodiment, multiple traveling shoes 401 exist to receive and hold a variety of conduit. To accommodate frequent traveling shoe 401 changes, the traveling shoe housing 402 is adapted to provide means for quick shoe change. In the preferred embodiment, the traveling shoe 401 is connected to the traveling shoe housing 402 by means of at least one detent pin.

It should be well understood that the traveling shoe assembly may take on a variety of embodiments still within the scope of the invention. For example, the traveling shoe 410 may be connected to the traveling shoe plate 403 by a variety of methods including using tool posts to affix the traveling shoe 410 to the traveling shoe assembly plate 403. The traveling shoe 401 may define at least one groove of at least one predetermined radius wherein the radius is determined from the Commercial Building Standard for Telecommunications Pathways and Spaces (EIA/TIA-569) or any other appropriate design code. In an alternative embodiment, the traveling shoe 401 may define a groove consisting of several predetermined radii.

Exemplary Rising Shoe Assembly

Figure 5A:
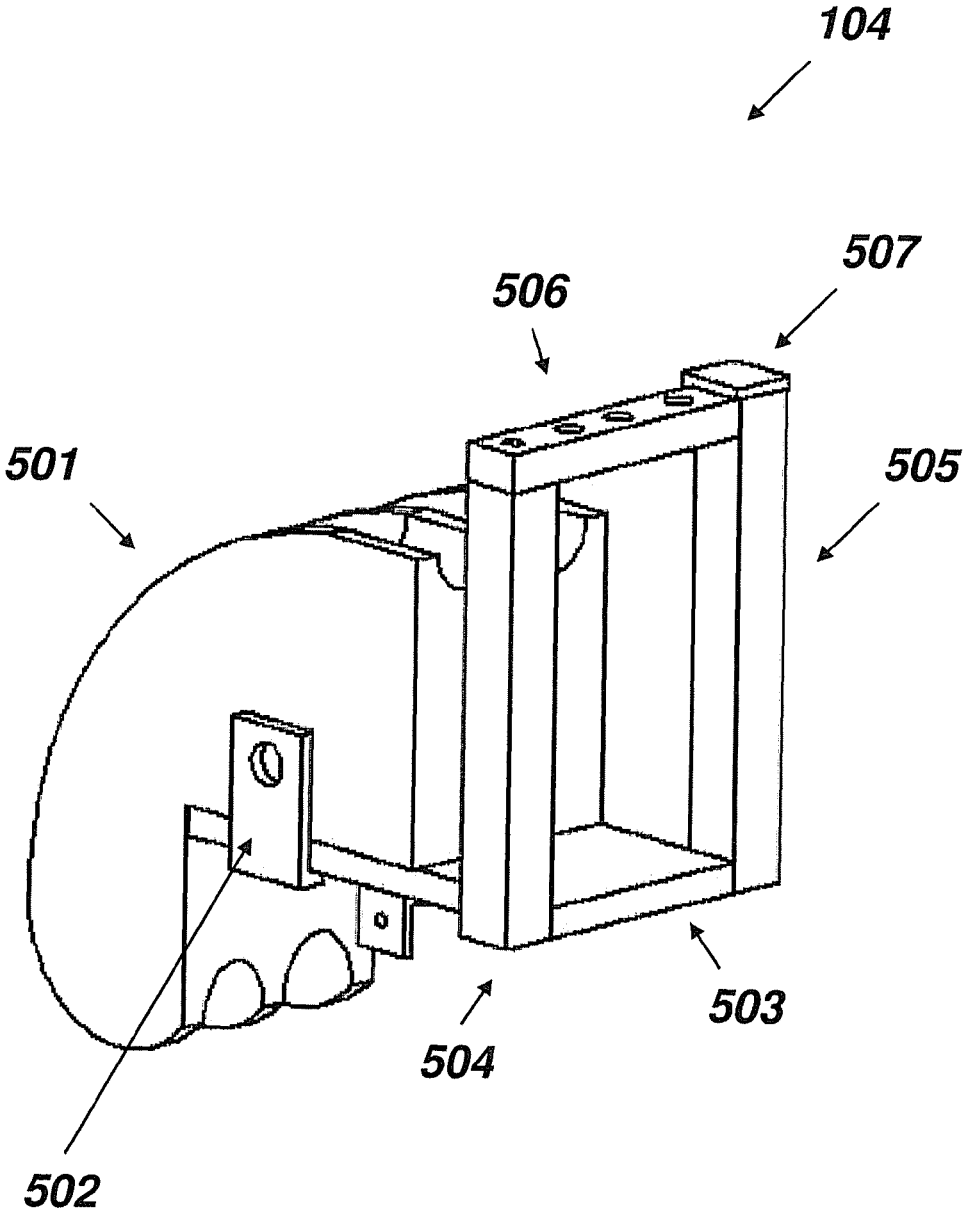
FIG. 5A is a perspective view of the rising shoe assembly of the bender shown in FIG. 1.
Figure 5B:
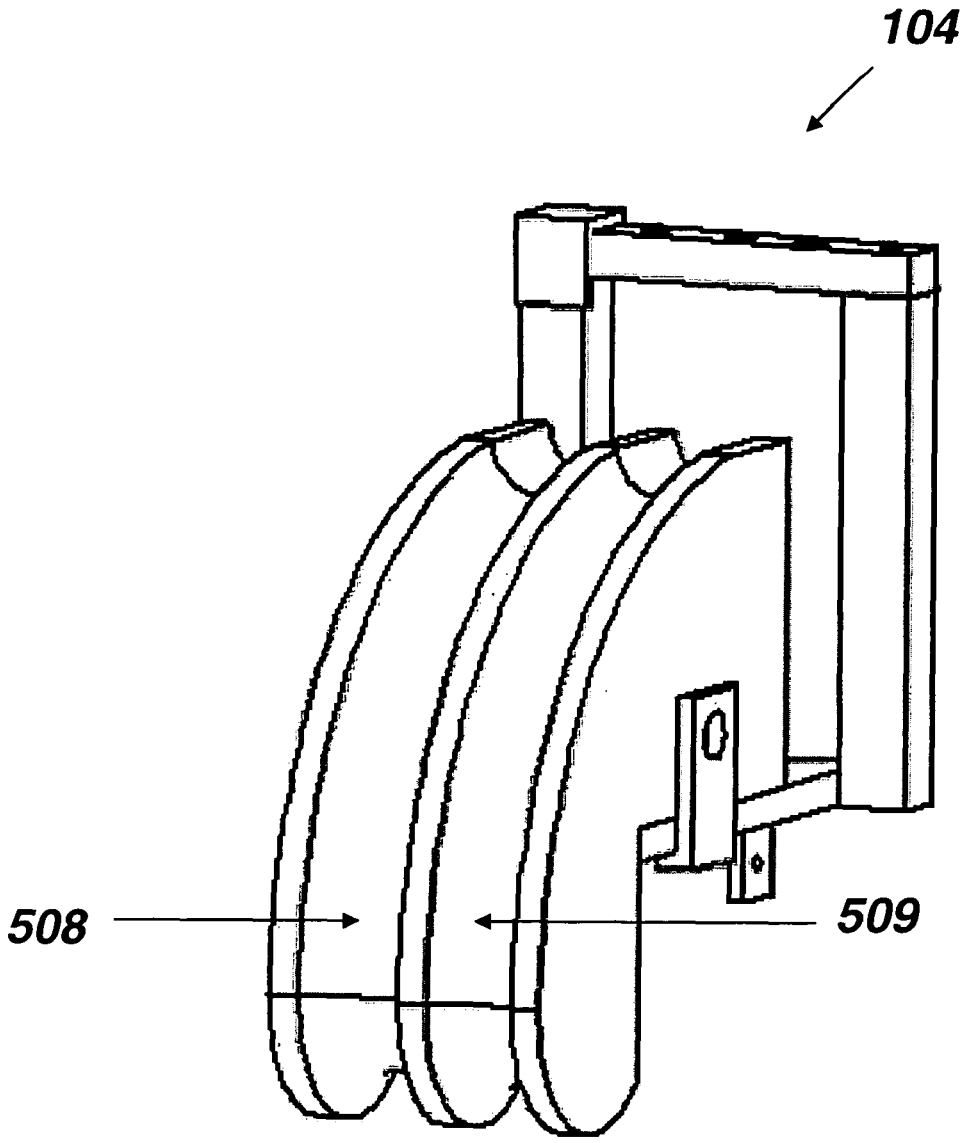
FIG. 5B is an additional perspective view of the rising shoe assembly of the bender shown in FIG. 1.
Figure 5C:
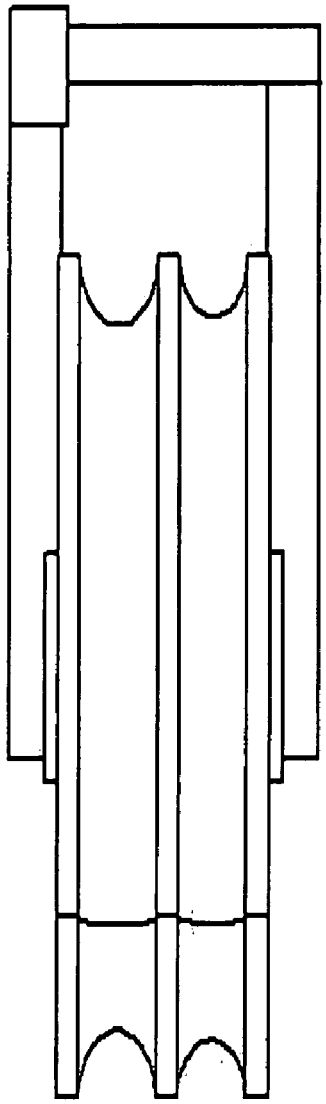
FIG. 5C is a front view of the rising shoe assembly of the bender shown in FIG. 1.
Figure 5D:
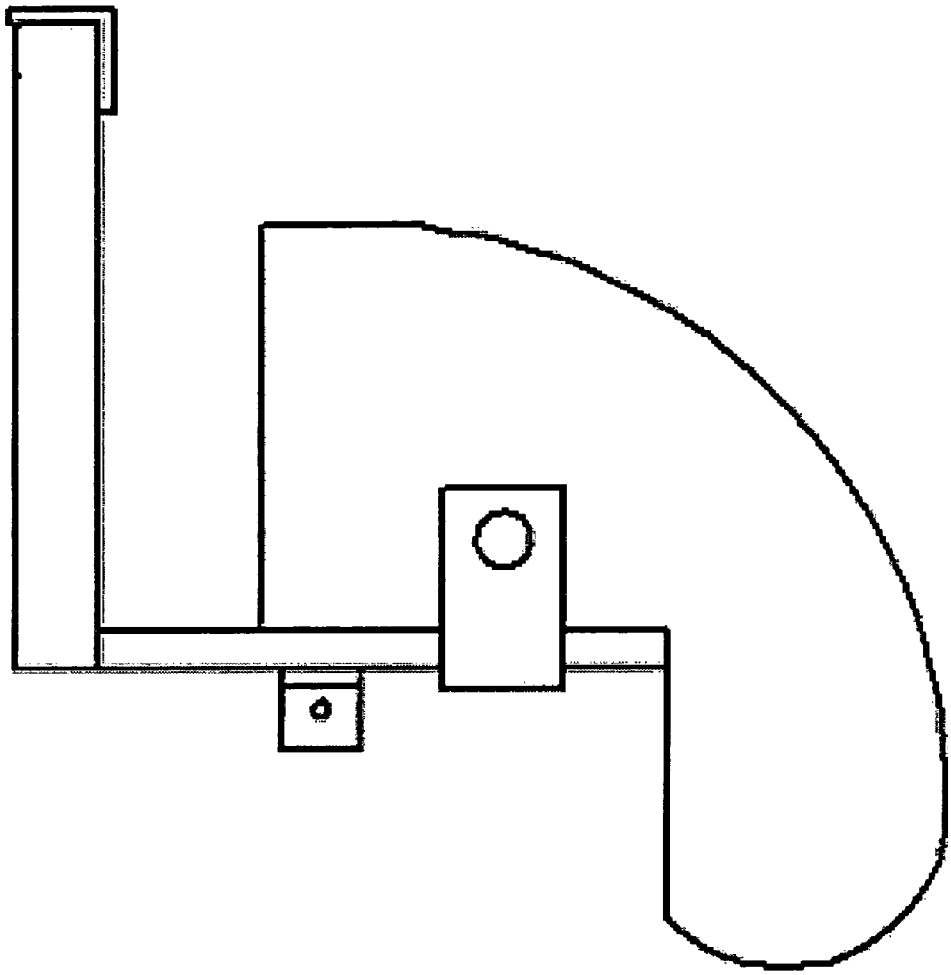
FIG. 5D is a side view of the rising shoe assembly of the bender shown in FIG. 1.
Figure 8A:
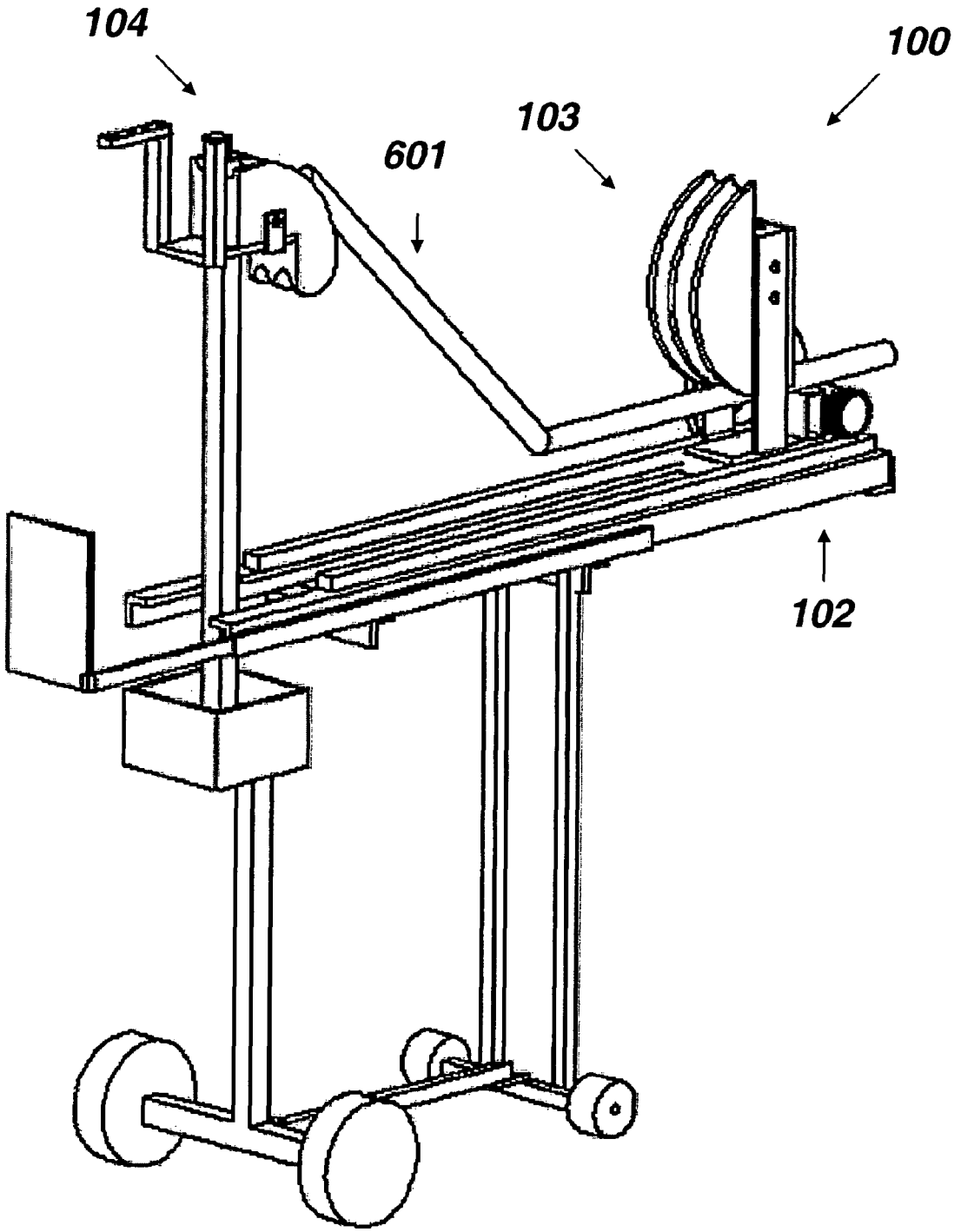
FIG. 8A is a perspective view of the bender shown in FIG. 6, showing a straight length of conduit being bent so as to form a kick bend.
Figure 8B:
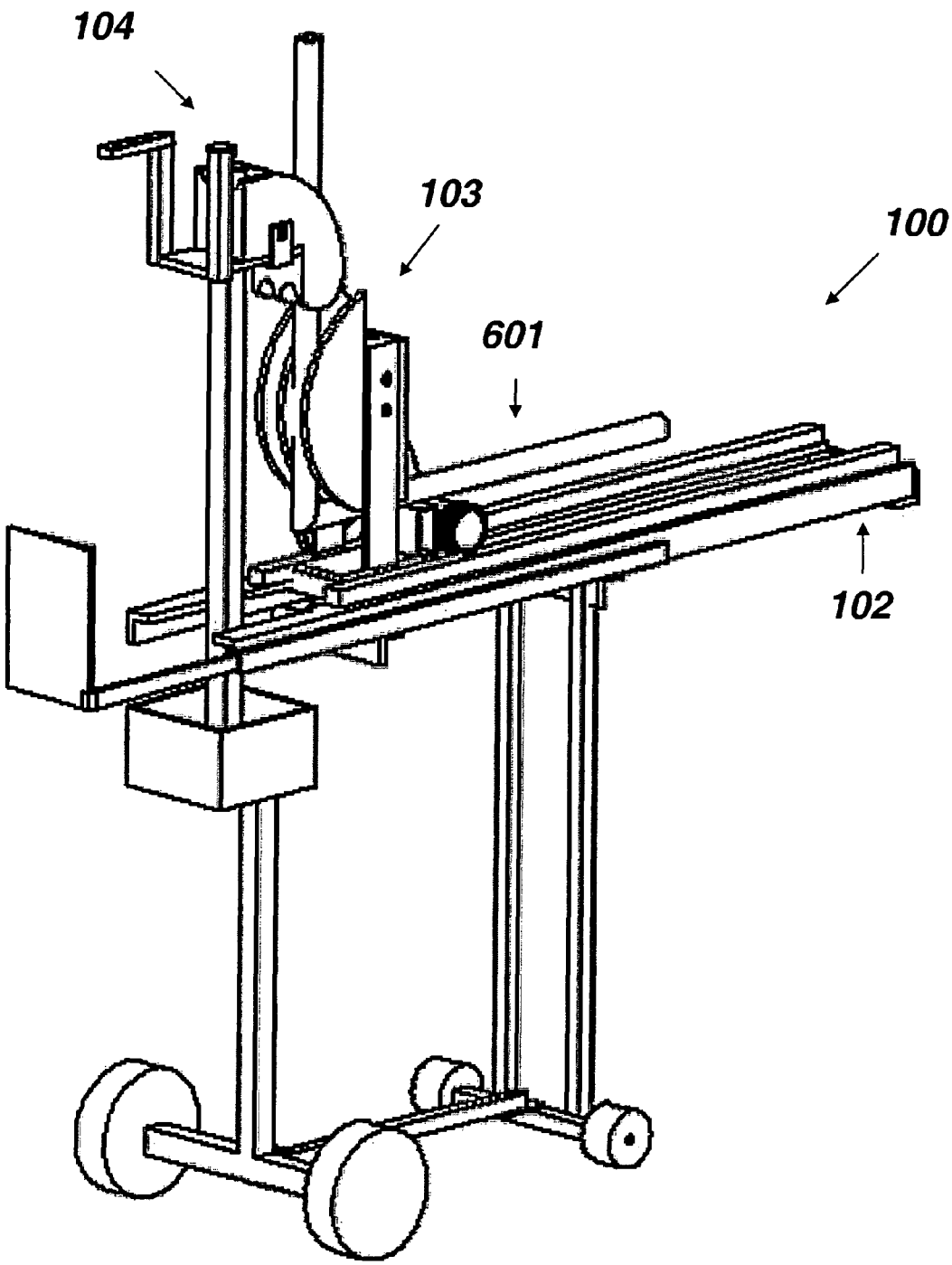
FIG. 8B is a perspective view of the bender shown in FIG. 8A, showing the kick bend being formed into a ninety degree bend.

Referring now to FIG. 5A-5D, the rising shoe assembly 104 is shown. FIG. 5A and FIG. 5B are perspective views of the rising shoe assembly and FIG. 5C and FIG. 5D are a side view and a front view of the rising shoe assembly 104, respectively. Referring to FIG. 5A, the rising shoe assembly 104 consists of a rising shoe 501 secured by a pair of rising shoe assembly plate holders 502 which are connected to a rising shoe assembly plate 503 which is oriented parallel to the bending deck 103. The rising shoe 501 is oriented so that it contacts and hangs over the front end of the rising shoe assembly plate 503. A first rising shoe assembly square bar 504 and a second rising shoe assembly square bar 505 are connected to the rising shoe assembly plate 503 at the back end of the rising shoe assembly plate 503. A rising shoe assembly front abutment 506 is attached to and is adapted to rotate on an axis parallel to the first rising shoe assembly square bar. A rising shoe assembly angle bar 507 is connected to the second rising shoe assembly square bar 505. The rising shoe assembly front abutment 506 may be rotated in such a way as to contact the rising shoe assembly angle bar 507. This configuration is considered to be closed. In the closed configuration, the rising shoe assembly front abutment 506 acts to provide a downward force on the conduit held by the rising shoe 501. In the preferred embodiment, this downward force is generated by having the conduit contact screws which are adjustably connected to the rising shoe assembly front abutment 506. It should be well understood that the downward force created by the rising shoe front abutment could be generated in several ways. In an alternative configuration, the rising shoe assembly front abutment 506 may be rotated in such a way as to not contact the rising shoe assembly angle bar 507, as seen in FIGS. 8A and 8B. This configuration is considered to be open.

Exemplary Rising Shoe

Referring to FIG. 5B, an additional perspective view of the rising shoe assembly 104 is shown. The rising shoe 501 consists of at least one receiver 508 defining a groove of a predetermined radius for receiving and substantially holding a length of electrical conduit of a predetermined outer diameter. FIG. 5B shows the rising shoe 501 having two receivers 508 and 509. The first receiver 508 currently defines a first radius to successfully bend 1¼ in EMT and the second receiver 509 currently defines a first radius to successfully bend 1 in GRC. The radii required for successful bending a length of conduit of a predetermined outer diameter can be determined by referencing appropriate conduit run design codes. For example, the first receiver 508 and the second receiver 509 define respective grooves of respective first radii that are recited in the National Electrical Code 346-10. The receivers 508 and 509 each define at least one groove having a second predetermined radius. This radius is considerably larger than the first radius and aides in making ninety degree bends. In the preferred embodiment, the second radii differ from the first radii by a factor of approximately one-half.

In the preferred embodiment, multiple rising shoes 501 will be created to receive and hold a variety of conduit. To accommodate frequent rising shoe 501 changes, the pair of rising shoe assembly plate holders 502 is adapted to provide means for quick shoe change. In the preferred embodiment, the rising shoe 501 is connected to the pair of rising shoe assembly plate holders by means of at least one detent pin.

It should be well understood that the rising shoe assembly may take on a variety of embodiments still within the scope of the invention. For example, the rising shoe 501 may be connected to the traveling shoe plate 503 by a variety of methods including using tool posts to affix the rising shoe 501 to the rising shoe assembly plate 503. The traveling shoe 501 may define at least one groove of at least one predetermined radius wherein the radius is determined from the Commercial Building Standard for Telecommunications Pathways and Spaces (EIA/TIA-569) or any other appropriate design code. In an alternative embodiment, the traveling shoe 501 may define a groove consisting of only one continuous predetermined radius.

Exemplary Bending in the Bender

Figure 6:
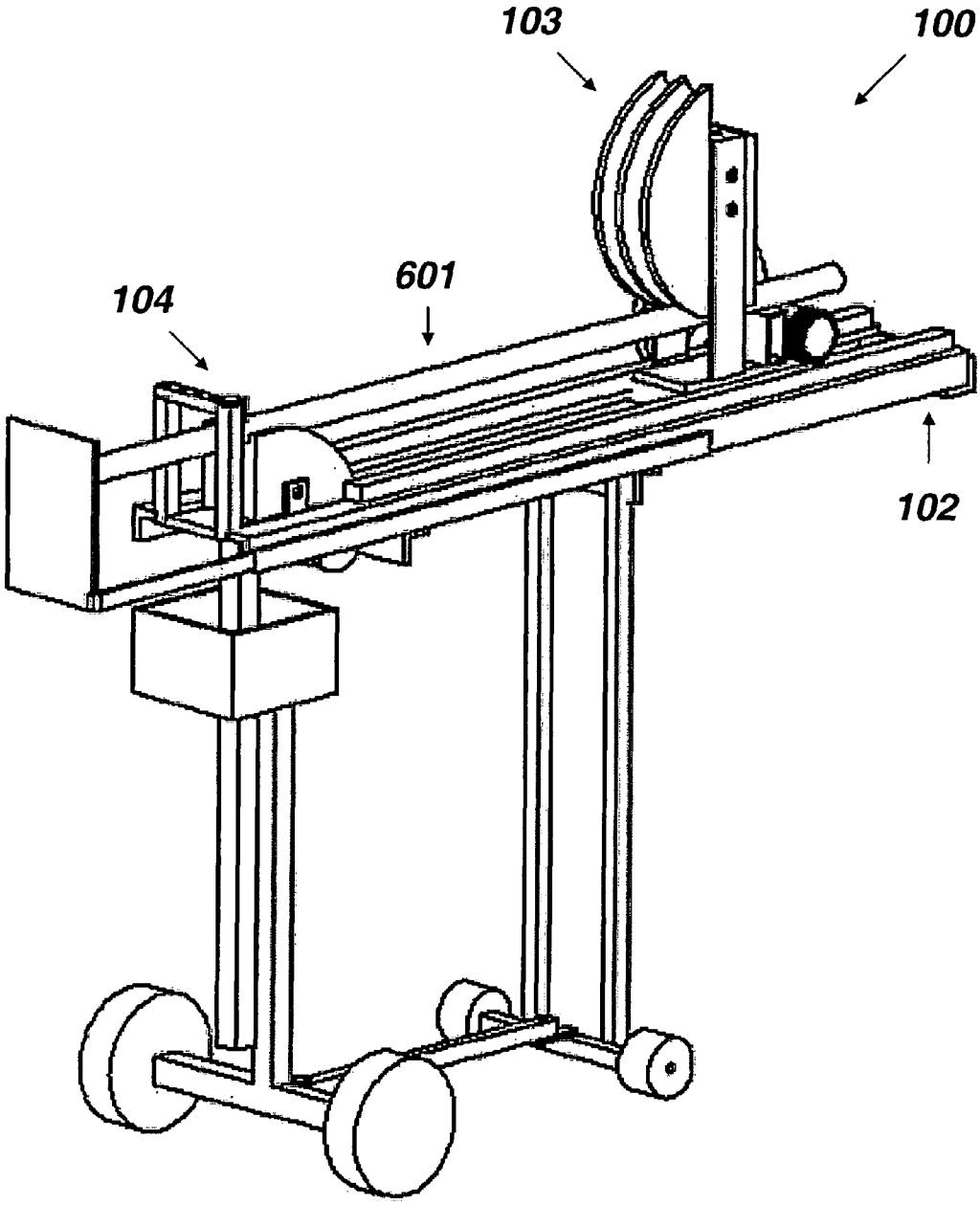
FIG. 6 is a perspective view of the bender shown in FIG. 1, showing a straight length of conduit inserted into the bender in the position for bending.

Referring to FIG. 6, a perspective view of the bender 100 is shown wherein a straight length of conduit 601 is loaded into the bender. Notice that a desired length of conduit is in contact with the traveling shoe assembly 103 and that a corresponding desired length of the conduit is in contact with the rising shoe assembly 104.

Exemplary Offset Bending

Figure 7:
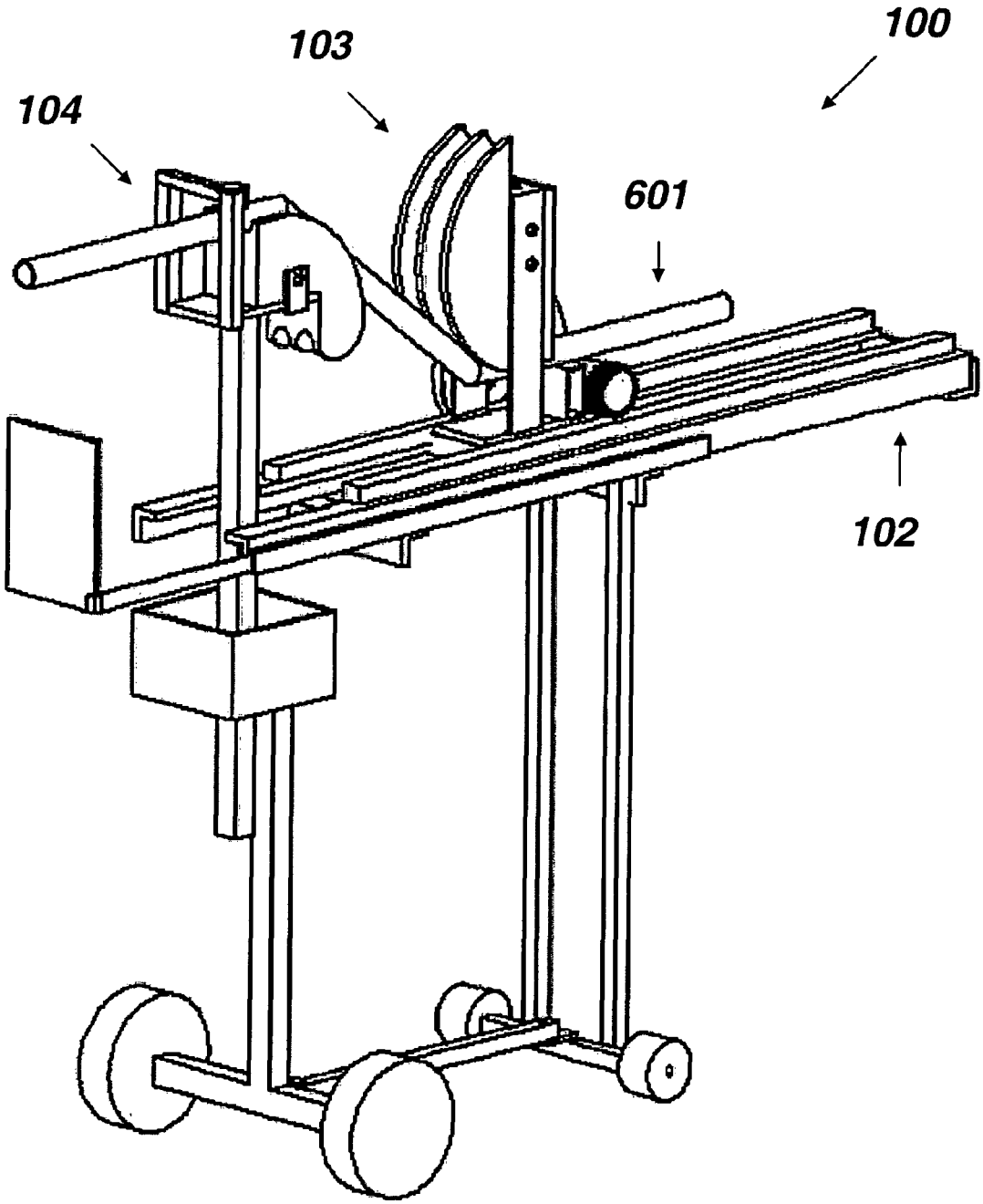
FIG. 7 is a perspective view of the bender shown in FIG. 6, showing the straight length of conduit being bent so as to form an offset bend.

Referring to FIG. 7, a perspective view of the bender 100 is shown wherein an offset bend has been made in a straight length of conduit 601. The desired length of the conduit that is in contact with the traveling shoe 103 assembly and the desired length of conduit that is in contact with the rising shoe assembly 104 determines the amount of bend that is made by the bender. In the preferred embodiment, the rising shoe assembly 104 is translated along an axis substantially perpendicular to the bending deck by the gearing system and electric motor housed in the rising shoe assembly housing 206. Responsive to the translation of the rising shoe assembly 104, the traveling shoe assembly 103 simultaneously translates along the surface of the first gear rack 301 and the second gear rack 302. The dual translation of the rising shoe 104 assembly and the traveling shoe assembly 103 cooperatively form equal and opposite bends in the conduit 601 which comprises an offset bend.

It will be readily appreciated by those skilled in the art that due to the phenomenon of elastic spring back conduit is never bent exactly to a desired angle. A user desiring a bend of a substantially a given angle will have to bend the conduit as if they desired a bend few degrees larger so as to take into account spring back.

Exemplary Method of Making a Ninety Degree Bend

Referring to FIGS. 8A and 8B, a perspective view of the bender 100 is shown wherein the method of making a ninety degree bend in a straight length of conduit 601 is shown. The method of making a ninety degree bend in a straight length of conduit 601 includes forming a kick bend in the conduit then translating the traveling shoe assembly such that it contacts the bend in the conduit 601 so that the angle between the first end of the conduit and the second end of the conduit is substantially transformed from at most a forty five degree angle to a substantially ninety degree angle.

Referring to FIG. 8A, a perspective view of the bender 100 is shown wherein a kick bend has been made in a straight length of conduit 601. The desired length of the conduit that is in contact with the traveling shoe assembly 103 and the desired length of conduit that is in contact with the rising shoe assembly 104 determines the amount of bend that is made by the bender. In the preferred embodiment, the rising shoe assembly 104 is translated along an axis substantially perpendicular to the bending deck by the gearing system and electric motor housed in the rising shoe assembly housing 206. Responsive to the translation of the rising shoe assembly 104, the traveling shoe assembly 103 simultaneously translates along the surface of the first gear rack 301 and the second gear rack 302. The dual translation of the rising shoe 104 assembly and the traveling shoe assembly 103 cooperatively form a kick bend in the conduit such that the first end of the conduit 601 is oriented to the second end of the conduit 601 at an angle that is substantially forty five degrees.

Referring to FIG. 8B, a perspective view of the bender 100 is shown wherein a ninety degree bend has been made in the straight length of the conduit 601. The ninety degree bend is successfully made in the conduit 601 by translating the traveling shoe assembly 103 along the surface of the first gear rack 301 and the surface of the second gear rack 302 by a user input torque applied to the hand wheel 409 such that the traveling shoe 301 contacts the bend comprising the kick bend in the conduit 601. The traveling shoe assembly 103 is then further translated along the surface of the first gear rack 301 and the second gear rack 302 by a user input torque applied to the hand wheel 409 so that the angle between the first end of the conduit and the second end of the conduit is substantially transformed from a substantially forty five degree angle to a substantially ninety degree angle.

It should be well understood that the method of making a ninety degree bend in the conduit does not require the formation of a full kick bend in the conduit 601 prior to translating the traveling shoe assembly 103 along the surface of the first gear rack 301 and the surface of the second gear rack 302 by a user input torque applied to the hand wheel 409.

The method of making a ninety degree bend in the conduit 601 may alternatively consist of the rising shoe assembly 104 is being translated along an axis substantially perpendicular to the bending deck by the gearing system and electric motor housed in the rising shoe assembly housing 206. Responsive to the translation of the rising shoe assembly 104, the traveling shoe assembly 103 simultaneously translates along the surface of the first gear rack 301 and the second gear rack 302. The dual translation of the rising shoe 104 assembly and the traveling shoe assembly 103 cooperatively form a bend in the conduit such that the first end of the conduit 601 is oriented to the second end of the conduit 601 at substantially at an angle that is less than forty five degrees. Following this step, the traveling shoe assembly 103 is translated along the surface of the first gear rack 301 and the surface of the second gear rack 302 by a user input torque applied to the hand wheel 409 such that the traveling shoe 301 contacts the bend comprising the foregoing bend in the conduit 601. The traveling shoe assembly 103 is then further translated along the surface of the first gear rack 301 and the second gear rack 302 by a user input torque applied to the hand wheel 409 so that the angle between the first end of the conduit and the second end of the conduit is substantially transformed from the foregoing angle to less than ninety degrees. These aforementioned method steps may be repeated in a repetitive series so as to incrementally form a substantially ninety degree bend in the conduit 601. In a further alternative embodiment, the aforementioned method steps may be reversed to still achieve a substantially ninety degree bend in the conduit.

A preferred embodiment of the invention has been described in considerable detail. Several modifications and variations of the preferred embodiment will be readily apparent to those skilled in the art. The true scope and spirit of the invention should not be limited to embodiment described, but should be defined by the following claims, and interpreted in light of the foregoing specification.

We claim:

1. A method for making one or more bends in an electrical conduit comprising a first end and a second end each of which is connected to and separated by a substantially straight length of conduit, the method comprising:

orienting the electrical conduit substantially parallel to a bending deck;

placing a first portion of the electrical conduit into a traveling shoe assembly located on the bending deck that translates along an axis substantially parallel to the bending deck;

placing a second portion of the electrical conduit into a rising shoe assembly initially located in a plane substantially parallel to the bending deck that translates along an axis substantially perpendicular to the bending deck such that the second end of the electrical conduit is relatively closer to the rising shoe assembly than the traveling shoe assembly;

forcibly translating the rising shoe assembly along the axis substantially perpendicular to the bending deck so as to make a bend in the electrical conduit wherein the first end of the electrical conduit is oriented at an angle to the second end of the electrical conduit that is substantially forty five degrees;

forcibly translating the traveling shoe assembly along the axis substantially parallel to the bending deck towards the rising shoe assembly so as to contact the bend in the electrical conduit such that the angle between the first end of the electrical conduit and the second end of the electrical conduit is transformed from the substantially forty five degree angle to a substantially ninety degree angle.

2. The method of claim 1, wherein the steps of forcibly translating the rising shoe assembly and forcibly translating the traveling shoe assembly may be performed one or more additional times so as to make at least one additional ninety degree bend in the electrical conduit.

* * * * *